US005343630A

United States Patent [19]

Ferguson, Sr.

[11] Patent Number: 5,343,630

[45] Date of Patent: Sep. 6, 1994

[54] FIBERGLASS RECYCLING SYSTEM

[76] Inventor: John H. Ferguson, Sr., P.O. Box 116, Linwood, N.C. 27299

[21] Appl. No.: 877,888

[22] Filed: May 1, 1992

[51] Int. Cl.[5] ..... F26B 5/08

[52] U.S. Cl. ..... 34/379; 34/58; 34/328

[58] Field of Search ..... 34/58, 57 E, 82, 79, 34/8, 56; 494/85

[56] References Cited

U.S. PATENT DOCUMENTS

| | | | |
|---|---|---|---|
| 3,400,467 | 8/1968 | Drace . | |
| 3,899,835 | 9/1975 | Meyer . | |
| 4,098,004 | 7/1978 | Rousselet | 34/58 X |
| 4,285,219 | 8/1981 | Grunewald . | |
| 4,467,530 | 8/1984 | Fesmire et al. . | |
| 4,965,917 | 6/1990 | Ferguson . | |
| 5,068,979 | 12/1991 | Wireman et al. | 34/58 |

*Primary Examiner*—Henry A. Bennet
*Attorney, Agent, or Firm*—Rhodes, Coats & Bennett

[57] ABSTRACT

A system used to recycle remnant fiberglass that has been removed from bobbins by water jets. The fiberglass recycling system includes a conveyor system for transporting the fiberglass to a centrifuge which dewaters wetted fiberglass. A detector having photoelectric devices is positioned at a discharge end of the conveyor system to detect dimensions of clusters of fiberglass conveyed past the discharge section of the conveyor. The detector is connected to a control unit which calculates the approximate amount of fiberglass conveyed past the detector and deposited into the centrifuge. In response to the amount of fiberglass detected, the control unit directs the operation and timing of the recycle system by selectively controlling the speed of the centrifuge and by placing the conveyor system between a discharge mode and an accumulation mode. A screen condenser is connected to the centrifuge by a conduit and a fan causes dewatered fiberglass in the centrifuge to be drawn through the conduit to the screen condenser where entrained air is removed from the fiberglass. Fiberglass is deposited from the screen condenser to a transport container.

17 Claims, 2 Drawing Sheets

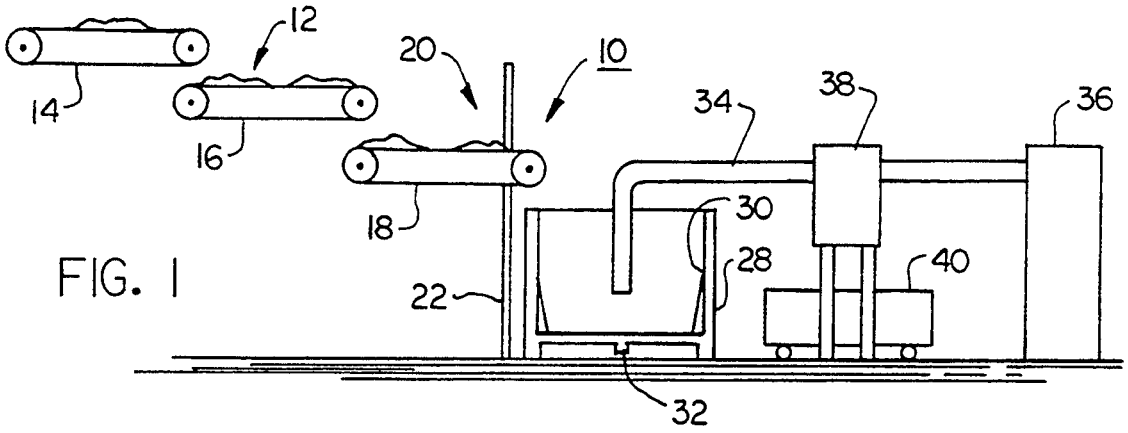
FIG. 1
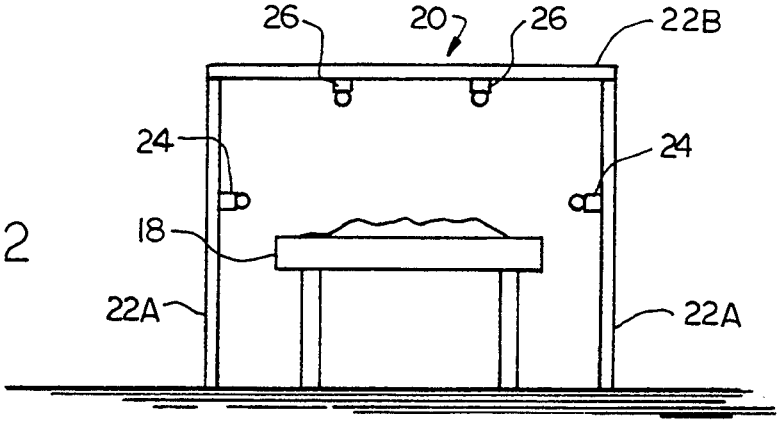
FIG. 2
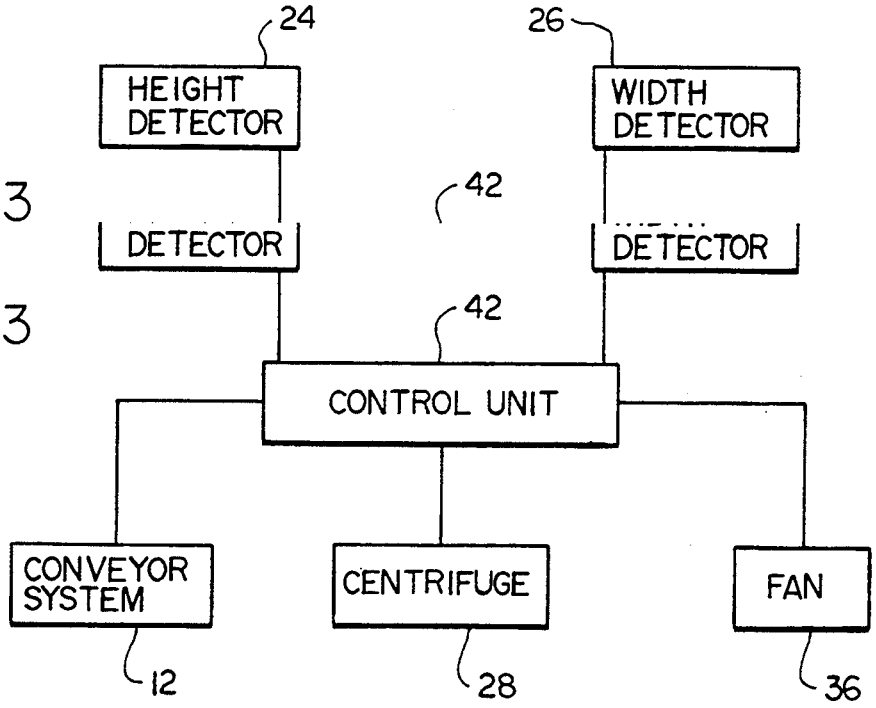
FIG. 3
FIG. 3

FIBERGLASS RECYCLING SYSTEM

FIELD OF INVENTION

The present invention relates generally to a system and method for recycling remnant fiberglass located on bobbins and more particularly to a system and method for automating the recycling of remnant fiberglass located on bobbins.

BACKGROUND OF THE INVENTION

Several manufacturing processes use fiberglass which is wound about bobbins. After use of fiberglass wound about the bounds, remnant fiberglass remains attached to the bobbins. The remnant fiberglass is removed from the bobbins and collected to prevent wastage of the remnant fiberglass and to permit reuse of the bobbins. As taught prior U.S. Pat. No. 4,965,917, the disclosure of which is incorporated herein by reference, to remove the remnant fiberglass from the bobbins, water jets are directed towards the bobbins to strip the fiberglass from the bobbins. During the removal process, water adheres to the fiberglass. The water adhering to the fiberglass must be removed prior to reusing the stripped fiberglass.

While various prior art apparatuses are known for dewatering textile fibers, none provide for dewatering fiberglass, nor do so with a convenient automatic operation.

SUMMARY AND OF THE INVENTION

The present invention provides a system and method for more effectively recycling fiberglass that has been stripped from bobbins with water jets. The recycling system includes a conveyor system having a plurality of interconnected conveyors used to transport stripped fiberglass to a centrifuge. The centrifuge includes a tapered inner wall that directs the fiberglass upwardly within the centrifuge when the centrifuge rotates so as to uniformly disperse the fiberglass.

A conduit extends into the centrifuge to provide a pathway for pneumatically removing fiberglass from the centrifuge. A fan connected to the conduit provides the necessary suction to pneumatically transport dewatered fiberglass from the centrifuge to a screen condenser where air entrained in the fiberglass is removed. The fiberglass falls from the screen condenser into a transport container that is used to transport the recycled fiberglass.

The operation of the recycling system is controlled by a detector means and a system control unit coupled to the detector means. The detector means includes photoelectric devices that are positioned about the conveyor system to detect the dimensions of fiberglass clusters being conveyed on the conveyor system towards the centrifuge. The control unit receives data representing the dimensions of the fiberglass clusters from the detector means and based on this data controls the operation of the conveyor system, centrifuge, and fan. More specifically, the control unit places the conveyor system between a discharge mode where fiberglass is conveyed into the centrifuge and an accumulation mode where fiberglass is conveyed toward the centrifuge but not deposited into the centrifuge. In addition, the control unit controls the operation of the centrifuge and fan so as to control the timing of the steps of the fiberglass recycle system.

Accordingly, it is an object of the present invention to provide a fiberglass recycling system that more effectively controls the operation and timing of the recycling process.

Another object of the present invention is to provide a fiberglass recycling system that includes a centrifuge having a construction that uniformly disburses the fiberglass in the centrifuge.

Another object of the present invention is to provide a detector means that includes photoelectric devices which detect the dimensions of clusters of fiberglass being transported on the conveyor.

Another object of the present invention is to provide a control unit coupled to a detector means for calculating the amount of fiberglass that has been deposited into the centrifuge.

Another object of the present invention is to provide a control unit that independently varies the speed of a plurality of conveyors to increase the number of cycles per hour that the fiberglass recycling system can process.

BRIEF DESCRIPTION OF TEE DRAWINGS

FIG. 1 is a schematic view of the fiberglass recycling system of the present invention.

FIG. 2 is a schematic end view of the detector means of the present invention.

FIG. 3 is a schematic diagram of the control unit connected to the components of the fiberglass recycling system.

DETAILED DESCRIPTION OF TEE INVENTION

Figure 4:
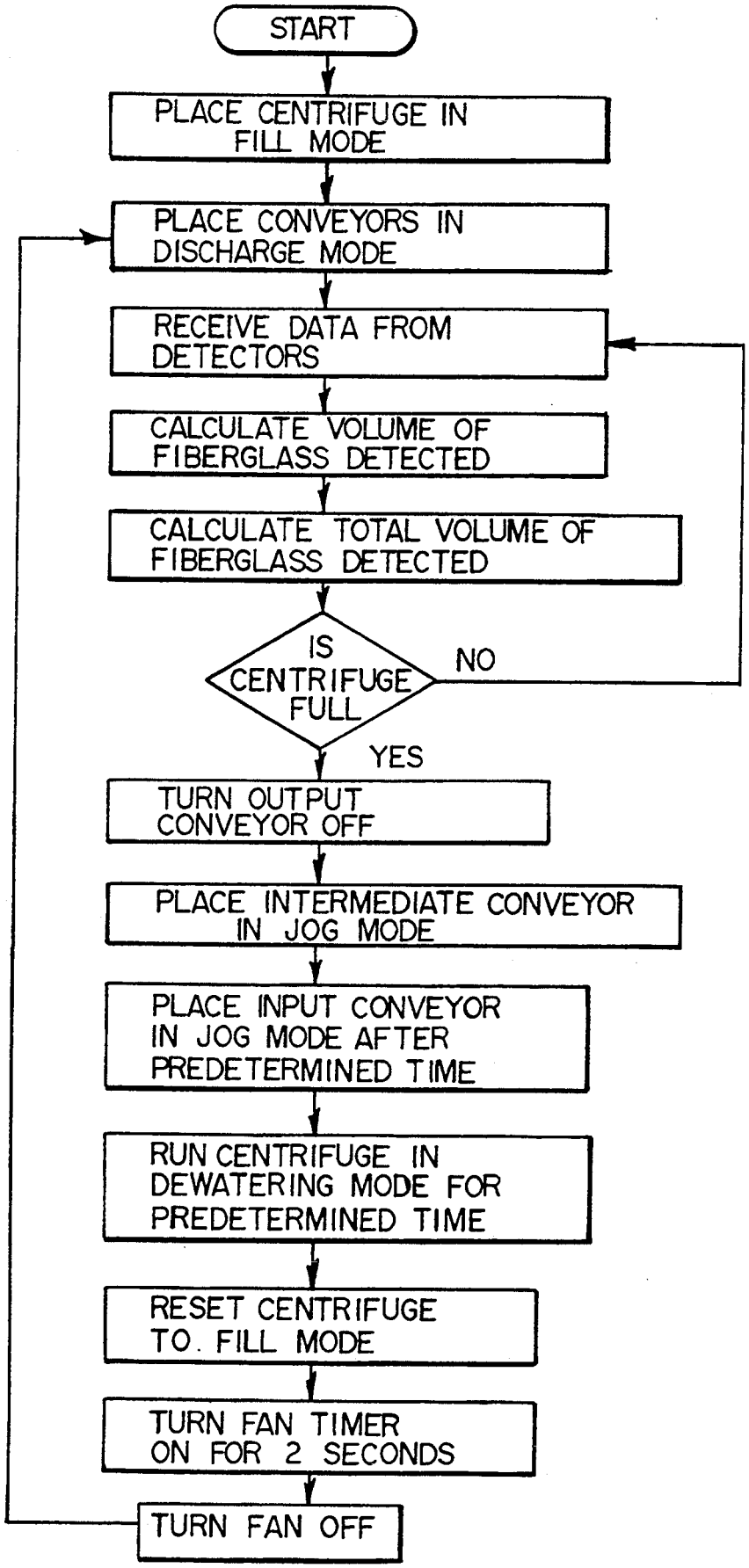
FIG. 4 is a flow diagram of the operational steps performed by the control unit of the present invention.

With further reference to the drawings, the fiberglass recycling system of the present invention is indicated generally by the numeral 10. As shown schematically in FIG. 1, the fiberglass recycling system 10 includes a conveyor system 12 having an input conveyor 14, an intermediate conveyor 16, and a discharge conveyor 18. The conveyor system 12 transports remnant fiberglass that has been stripped from bobbins to a centrifuge 28 located adjacent to the discharge conveyor 18. The fiberglass is transported from the input conveyor 14 to the intermediate conveyor 16 and then to the discharge conveyor 18 which deposits the fiberglass into the centrifuge 28.

Located at the discharge end of discharge conveyor 18 is a detector means 20. As shown in FIG. 2, detector means 20 includes a pair of vertical support legs **22*a* and a cross bar 22*b* extending between the pair of vertical legs 22*a*. Attached to the vertical legs 22*a* are photoelectric height detectors 24. Photoelectric height detectors 24 are positioned adjacent to the sides of the discharge conveyor 18** and slightly above the discharge conveyor's surface oriented down onto the conveyor.

In the preferred embodiment, the height detectors 24 and fiber detectors 26 are photoelectric devices that transmit and sense light. Fiber detectors 26 detect the extent to which clusters of fiberglass extend across the width of the discharge conveyor 18 by detecting the differing reflection characteristics of light contacting the black or dark conveyor surface and light contacting the white fiberglass spread about the conveyor's surface at random locations. More specifically, light reflects poorly or not at all when it contacts the conveyor's black or dark surface. In contrast, light readily reflects from the white fiberglass. Fiber detectors 26 can thus detect the presence of fiberglass passing beneath cross bar 22*b* by detecting the absence or presence of reflected light from the conveyor surface located beneath the cross bar 22*b*. Fiber detectors 26 are positioned above the surface of the discharge conveyor 18 and are spaced along the width of the discharge conveyor 18. By emitting light downwardly onto the conveyor system 12 and across the width of the conveyor system 12, fiber detectors 26 are able to detect the absence and presence of wetted fiberglass passing below on the conveyor 18.

One of photoelectric height detectors 24 emits light laterally across discharge conveyor 18, and the other detects when the wetted fiberglass being conveyed past vertical support legs 22*a* blocks the emitted light. Fiberglass clusters not extending substantially above the surface of discharge conveyor 18 will not block, or will only partially block, the light emitted from the one height detector 24. Thus, height detectors 24 are able to approximate the height of a pile of fiberglass passing by vertical support legs 22*a*.

Height detectors 24 and fiber detectors 26 produce data that represents the height that the wetted fiberglass extends above the surface of the discharge conveyor 18 and the width over which the wetted fiberglass extends laterally across discharge conveyor 18. As seen in FIG. 3, this data is relayed to a control unit 42 which calculates from this data a measure of the volume of fiberglass passing by detector means 20 and being deposited into centrifuge 28. As will be described in more detail below, control unit 42 controls the operation and timing of system 10 based on preprogrammed instructions stored in the control unit's memory.

At the discharge end of discharge conveyor 18 is centrifuge 28 which receives wetted fiberglass conveyed past detector means 20. The centrifuge 28 is shown schematically in FIG. 1. The centrifuge 28 includes a rotatable drum having inner walls 30 which taper outwardly from a bottom. A drain 32 is located in the bottom of centrifuge 28 for draining fluid expelled from the fiberglass by centrifuge 28. The tapered inner walls 30 cause the wetted fiberglass to be distributed evenly up the walls when the centrifuge 28 is actuated, as will be described more fully below.

A conduit 34 extends into centrifuge 28 offset from the axis of rotation of the drum and connects centrifuge 28 with a standing screen condenser 38. Fan 36 provides a vacuum suction to conduit 34 to pull dewatered fiberglass from centrifuge 28 into screen condenser 38. Screen condenser 38 removes air entrained in the fiberglass and deposits the fiberglass into a transport container 40.

As shown in FIG. 3, control unit 42 is connected to height detector 24, width detector 26, conveyor system 12, centrifuge 28, and fan 36. Control unit 42 controls the operation of fiberglass recycle system 10 as will be described below.

Referring to the flow chart in FIG. 4, fiberglass recycle system 10 operates as follows. An operator turns on fiberglass recycle system 10, causing control unit 42 to signal centrifuge 28 to begin running in a fill mode, such that the drum of the centrifuge 28 rotates at a slow speed. In addition, the control unit 42 places conveyors 14, 16 and 18 in a discharge mode for transporting wetted fiberglass to centrifuge 28. After the operator has started the fiberglass recycle system 10, wetted fiberglass that has been stripped from bobbins is transferred onto input conveyor 14. The wetted fiberglass placed on input conveyor 14 is conveyed to intermediate conveyor 16 and then to discharge conveyor 18. As the wetted fiberglass is conveyed past detector means 20, height detectors 24 and width detectors 26 detect both the height and width of the fiberglass clusters being deposited into the centrifuge 28. As shown in FIG. 1, the wetted fiberglass arrives in clusters or patches of fiberglass on the surface of conveyors 14, 16 and 18. Detector means 20 detects the dimensions of these clusters as they pass the detector support frame 22.

The data from the detectors is sent to and received by control unit 42. Upon receiving detector data from the detectors 24 and 26, control unit 42 uses the dimensional data of the fiberglass to calculate the volume of fiberglass passing by detector support frame 22. By calculating the volume of fiberglass that passes by detector support frame 22, the control unit 42 can calculate the amount of fiberglass that is deposited into centrifuge 28. The amount of fiberglass passing detector support frame 22 and being deposited in centrifuge 28 accrues as additional clusters of fiberglass pass detector support frame 22. Control unit 42 continuously adds the volume of fiberglass detected from each new cluster to the accumulated volume of fiberglass detected. Control unit 42 checks to see if the accumulated volume has reached a predetermined level corresponding to the centrifuge 28 being at a full level. The conveyor system 12 continues to operate and the control unit 42 continues to add the volume of clusters of fiberglass passing the detector means 20 until the centrifuge 28 is determined to be full.

Upon determining that centrifuge 28 is full, control unit 42 performs several steps to place conveyor system 12 in an accumulation mode. Discharge conveyor 18 is turned off, intermediate conveyor 20 is placed in a jog mode to slow the rate at which fiberglass is conveyed, and input conveyor 14 is allowed to run in a normal discharge mode for a predetermined time and then placed in a jog mode. The independent control of the conveyors 14, 16, and 18 provides for independent control of the input and discharge sections of conveyor system 12 and provides efficient conveyance of wetted fiberglass to centrifuge 28. More specifically, it is necessary to shut off discharge conveyor 18 once centrifuge 28 is fully loaded so that additional fiberglass is not conveyed into a full centrifuge 28 causing overloading. However, by maintaining operation of input conveyor 14 and intermediate conveyor 16 at a slow rate of speed, wetted fiberglass can be accumulated at a position closer to centrifuge 28 despite the centrifuge 28 being fully loaded and the discharge conveyor 18 being turned off.

Once centrifuge 28 is prepared to begin accepting additional loads of fiberglass, the continued jog-made running of the intermediate and input conveyor systems 14 and 16 results in fiberglass being better positioned to fill centrifuge 28 in a shorter period of time. Placing intermediate conveyor 16 and discharge conveyor 18 at a slower rate when centrifuge 28 is in a full mode prevents an excess amount of fiberglass from being deposited onto the input end of the discharge conveyor 18. An excess amount of fiberglass deposited onto the input end of the discharge conveyor 18 may result in wetted fiberglass spilling from the discharge conveyor 18, piling to a level that cannot be adequately read by the height detectors 24, or may place too much weight on one point of the discharge conveyor thereby straining the discharge conveyor 18.

Upon the detection of a full load in centrifuge 28, control unit 42 signals the centrifuge to rotate its drum at high speed for a predetermined time period. This removes liquid adhered to the fiberglass by centrifugal force. The actual number of seconds required for a batch of fiberglass to be dewatered in the dewatering mode will depend upon the characteristics of the fiberglass recycle system 10 and the amount of water adhered to the fiberglass in centrifuge 28. The centrifuge timer should be set for a sufficient number of seconds to fully dewater a full load of fiberglass placed in centrifuge 28. Centrifuge 28 will run in a dewatering mode until centrifuge timer cuts off after the predetermined time period ends.

The tapered walls 30 of the drum of centrifuge 28 have several advantages. The tapered walls 30 cause fiberglass deposited into centrifuge 28 to be forced upwardly along the tapered walls 30. This results in the fiberglass being more uniformly dispersed throughout the centrifuge 28 and water being more effectively removed from the fiberglass. Accordingly, centrifuge 28 more effectively removes water from the fiberglass and is better balanced during operation. As is well known in the centrifuge art, a uniform distribution of materials to be centrifuged is important to prevent destructive vibrations. Upon completion of the dewatering of the fiberglass, centrifuge 28 is placed in a slow, discharge mode by control unit 42. This causes the dewatered fiberglass to fall downwardly from the tapered side walls 30 of centrifuge 28. The tapered shape of side walls 30 aids in producing dewatered fiberglass that is fluffy and easily pneumatically transported by the conduit 34 from the centrifuge 28 to screen condenser 38.

After the predetermined time period has elapsed, the centrifuge 28 returns to the fill mode and control unit 42 turns the fan timer on for a second predetermined time period. This causes fan 36 to turn on and produce a vacuum pull on conduit 34. The dewatered fiberglass is sucked into conduit 34 and is pneumatically transported to screen condenser 38. Screen condenser 38 removes the entrained air in the fiberglass, and the fiberglass is deposited into a transport container 40. The time necessary to fully transport dewatered fiberglass from the centrifuge 28 to transport container 40 will depend upon the size of the fiberglass batch in centrifuge 28 and other characteristics of recycle system 10. At the end of the second predetermined time period, the fan 36 is turned off and a complete cycle of the recycle system 10 has been completed.

The control unit 42 recycles to begin the cycle over and dewater an additional batch of wetted fiberglass. The control unit 42 used in conjunction with the other components of recycle system 10 allow for an increased number of loads or batches to be processed per hour. In the preferred embodiment, approximately twenty starts or batches per hour can be performed by the fiberglass recycle system 10.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A fiberglass recycling system for the dewatering of fiberglass that has been stripped from bobbins by liquid jets, comprising:

a) a conveyor system for transporting clusters of wetted fiberglass from an input section to a discharge section;

b) a centrifuge disposed adjacent to the discharge section of the conveyor system for receiving and dewatering the wetted fiberglass;

c) means for detecting and measuring the quantity of fiberglass clusters passing on the conveyor system and being discharged into the centrifuge; and d) control means responsive to the detection means for controlling the speed of the centrifuge in relationship to the detected amount of fiberglass discharged from the conveyor system into the centrifuge.

2. The fiberglass recycling system of claim 1 wherein the detecting means includes a fiber detector positioned above the conveyor surface for ascertaining the presence of fiberglass clusters and a height detector positioned adjacent to one side of the conveyor system for measuring the height of the fiberglass clusters.

3. The fiberglass recycling system of claim 2 wherein the fiber detector and height detector are photoelectric devices.

4. The fiberglass recycling system of claim 1 wherein the control means includes means for increasing the speed of the centrifuge to dewater the fiberglass once a predetermined volume of fiberglass has been deposited into the centrifuge.

5. The fiberglass recycling system of claim 4 wherein the control means decreases the speed of the centrifuge after a predetermined time period sufficient to allow for the dewatering of fiberglass contained within the centrifuge.

6. The fiberglass recycling system of claim 1 wherein the centrifuge is operable in a fill mode where the centrifuge spins at a relatively slow speed and in a dewatering mode where the centrifuge spins at a relatively fast speed; wherein the conveyor system is operable to run in a discharge mode where fiberglass is conveyed by the conveyor system and discharged into the centrifuge and an accumulation mode where at least a portion of the conveyor system conveys fiberglass toward the discharge section of the conveyor system while the discharge section does not discharge fiberglass into the centrifuge; and wherein the fiberglass recycling system further includes conveyor speed control means for maintaining the conveyor system in the discharge mode while the centrifuge is in the fill mode and for maintaining the conveyor system in the accumulation mode while the centrifuge is in the dewatering mode.

7. The fiberglass recycling system of claim 6 wherein the input section of the conveyor system in the accumulation mode runs at a relatively slow speed compared to the speed of the conveyor system in the discharge mode.

8. The fiberglass recycling system of claim 7 wherein the conveyor system further includes an intermediate section positioned between the input and discharge sections.

9. The fiberglass recycling system of claim 8 wherein the intermediate section of the conveyor system in the accumulation mode runs at a relatively slow speed compared to the speed of the conveyor system in the discharge mode.

10. The fiberglass recycling system of claim 1 further including:

a) pneumatic transport means for pneumatically transporting dewatered fiberglass from the centrifuge;

b) air removal means for removing entrained air from the dewatered fiberglass being transported by the pneumatic transport means; and c) a transport container for collecting fiberglass from the air removal means.

11. The fiberglass recycling system of claim 10 wherein the air removal means is a screen condenser.

12. A fiberglass recycling system for the dewatering of fiberglass that has been stripped from bobbins by liquid jets, comprising:

a) a conveyor system for transporting clusters of fiberglass from an input section to a discharge section;

b) a centrifuge disposed adjacent the discharge section of the conveyor for receiving and dewatering the fiberglass clusters, the centrifuge having inner walls that taper outwardly from a bottom for causing fiberglass to be forced upwardly along the tapered walls as the centrifuge rotates so as to uniformly disperse the fiberglass in the centrifuge; and c) a drive mounted to rotate said centrifuge.

13. The fiberglass recycling system of claim 12 further including pneumatic transport means for pneumatically transporting dewatered fiberglass from the centrifuge and a screen condenser for removing entrained air from the fiberglass being transported from the centrifuge.

14. A method of recycling fiberglass that has been stripped from bobbins by water jets, said method comprising:

a) conveying the fiberglass on a conveyor system from an input section to a discharge section;

b) depositing the fiberglass from the discharge section of the conveyor into a centrifuge;

c) detecting and measuring the quantity of fiberglass clusters passing on the conveyor system and being discharged into the centrifuge; and d) controlling the speed of the centrifuge in relationship to the detected amount of fiberglass discharged from the conveyor system into the centrifuge.

15. The method of claim 14 further including speeding up the centrifuge from a relatively slow speed to a relatively fast speed for a predetermined period of time sufficient to dewater the fiberglass contained within the centrifuge and then removing the dewatered fiberglass from the centrifuge.

16. The method of claim 15 further comprising the steps of discharging the fiberglass into the centrifuge and spinning the centrifuge at a relatively slow speed until the centrifuge is filled to a selected level, and then placing the conveyor system in an accumulation mode and increasing the speed of rotation of the centrifuge while ceasing to discharge fiberglass into the centrifuge.

17. The method of claim 16 further comprising the steps of driving the conveyor system at a relatively high speed when the same is operated in the discharge mode and driving the input section of the conveyor system at a relatively slow speed when the same is maintained in the accumulation mode.

* * * * *